US005590506A

United States Patent [19]

Cunningham

[11] Patent Number: 5,590,506

[45] Date of Patent: Jan. 7, 1997

[54] EARTHQUAKE-RESISTANT ARCHITECTURAL SYSTEM

[76] Inventor: John Cunningham, 35 Loughberry Rd., Saratoga Springs, N.Y. 12866

[21] Appl. No.: 57,126

[22] Filed: May 3, 1993

[51] Int. Cl.[6] ..... F16M 13/00; E04H 9/02

[52] U.S. Cl. ..... 52/741.3; 52/167.7; 52/167.8; 52/292; 52/167.4; 52/741.1; 248/608; 248/678; 248/560

[58] Field of Search ..... 52/167 R, 167 RM, 52/292, 293.1, 573.1, 741.1, 745.12, 721, 730.1, 167.1, 167.4–167.8, 721.1, 741.3; 248/560, 562, 608, 424, 568, 580, 581, 602, 611, 618, 678

[56] References Cited

U.S. PATENT DOCUMENTS

| | | | |
|---|---|---|---|
| 363,970 | 5/1887 | Sherwood | 14/14 |
| 382,207 | 5/1888 | Barrow | 248/560 |
| 1,781,517 | 11/1930 | McKeown | 52/573.1 X |
| 2,021,370 | 11/1935 | Mallay | 248/560 |
| 2,722,040 | 11/1955 | Ludowici | 52/293.1 X |
| 2,945,248 | 7/1960 | Meagher et al. | 52/573.1 X |
| 3,269,069 | 8/1966 | Carlson | 52/223.7 |
| 3,784,146 | 1/1974 | Matthews | 248/562 |
| 4,004,766 | 1/1977 | Long | 248/55 |
| 4,588,154 | 5/1986 | Basore | 248/99 |
| 4,946,128 | 8/1990 | Cunningham . | |
| 5,148,642 | 9/1992 | Plumier et al. | 52/167 R |
| 5,205,528 | 4/1993 | Cunningham . | |

FOREIGN PATENT DOCUMENTS

| | | | |
|---|---|---|---|
| 1432170 | 10/1988 | U.S.S.R. | 52/167 R |

*Primary Examiner*—Robert Canfield
*Attorney, Agent, or Firm*—Porter Wright Morris & Arthur

[57] ABSTRACT

A system for supporting an architectural element such that the supporting structure resists unexpected, infrequent shocks such as might be encountered during an earthquake or other disaster and isolates the architectural element from variations in the level or stability of the surface on which the structure rests. The system provides an apparatus for supporting an architectural element that includes a pair of laterally spaced apart fixed bearing members arranged on a surface beneath or adjacent to a site for an architectural element, and an elongated elastic member supported on bearing surfaces of the bearing members at a distance spaced inwardly from the ends of the elongated member. An architectural element, which may comprise a base for a building or other structure, a building, or a portion of a building, may be placed in association with the elongated member. Beginning from an equilibrium state, the elongated member is capable of bending in proportion to the magnitude of an additional load applied intermediate the ends of the elongated members, with the ends of the elongated members sliding against the bearing members a distance also proportional to the magnitude of the additional load.

4 Claims, 4 Drawing Sheets

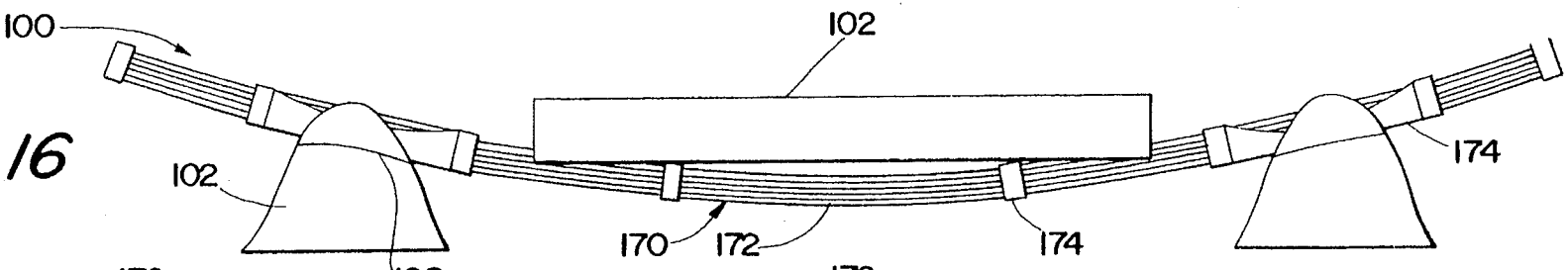
Fig. 16
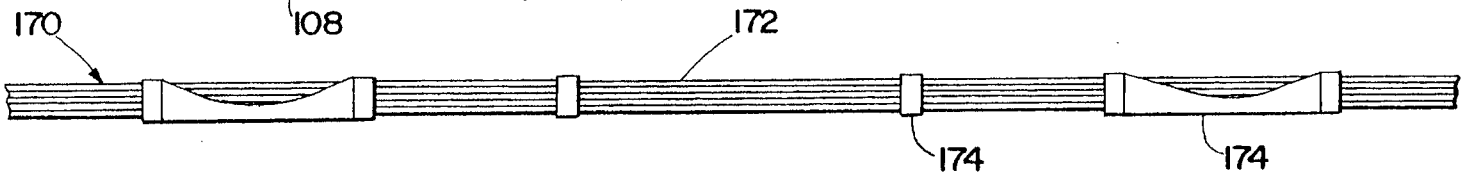
Fig. 17
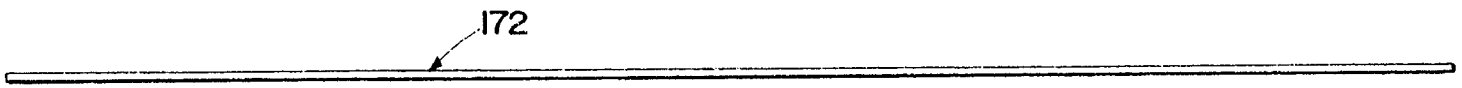
Fig. 18
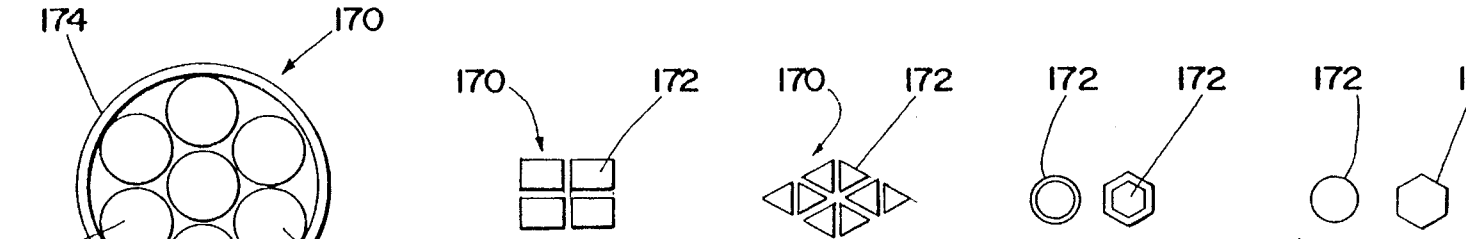
Fig. 19
Fig. 20a
Fig. 20b
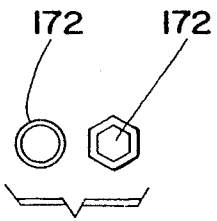
Fig. 20c
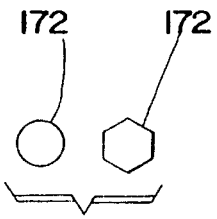
Fig. 20d

EARTHQUAKE-RESISTANT ARCHITECTURAL SYSTEM

BACKGROUND AND SUMMARY OF THE INVENTION

The present invention relates to a system for supporting an architectural element, and more particularly, to a homeostatic system for supporting an architectural element such that the supporting structure resists unexpected, infrequent shocks such as might be encountered during an earthquake or other disaster and isolates the architectural element from variations in the level or stability of the surface on which the supporting structure rests.

Buildings and other architectural structures may be built in locations where such structures are susceptible to damage from seismic shocks. Conventional construction methods frequently result in essentially rigid structures, i.e., structures that do not yield appreciably on the application of an external force. When an external force is applied to such a rigid structure, a variety of tensile, compressive and bending forces may be created within the structure. If the external force is sufficiently high, the structure may fail, resulting in damage to the structure and the risk of harm to persons and property in and around the structure. To reduce the risk of such occurrences, existing methods for constructing rigid structures in such locations frequently call for overdesign of at least some portions of these structures.

Methods for constructing rigid structures may include the use of devices, such as rubber bearings containing a core of lead to absorb heat, to provide some degree of seismic isolation to these structures. These isolating devices have several known disadvantages. The devices depend on the interaction of specialized materials, some of which tend to deteriorate over time, resulting in decreased protective capacity or increased expenses associated with periodic replacement. Known bearings also are unlikely to be capable of responding to the magnitude of the displacement associated with a severe seismic event. Bearings that lack sufficient shock-absorbing capability may exaggerate rather than minimize the effects of seismic shock.

Other known construction methods result in flexible structures that are capable of yielding to an external force. However, because these structures generally lack means for effectively dissipating energy, they tend to store the energy associated with application of an external force in a spring-like manner, resulting in undesirable oscillation of the structures. Such oscillation may disrupt use of a flexible structure, for example, during high wind conditions. Under more extreme conditions, oscillation of a flexible structure may result in damage to the structure and the risk of harm to persons and property, as described above.

Buildings and other architectural structures also may be built in locations where soil or other surface conditions are not conducive to placement of the structures directly upon the ground. In such cases, the buildings may be constructed upon a platform or similar structure supported above the ground. Conventional methods for supporting structures above a surface have the same shortcomings as the above-described building construction methods. In addition, these conventional methods generally are ineffective in isolating the structures from variations in the level or stability of the surface on which the supporting structure rests. For example, erosion or settling of loosely packed soils may alter the level of a portion of the surface on which the supporting structure rests. Variations in the water table, or the seasonal freezing and thawing of the soil in extremely cold regions, including permafrost soil, may affect the consistency of the surface underlying a structure. Surface changes such as these may be transmitted to a conventional supporting structure, resulting in damage to the structure placed thereon and the risk of harm to persons and property, as described above.

The system of the present invention may be practiced using simple construction techniques and materials, requires minimal maintenance, and is capable of reacting to displacements of a large magnitude. The present invention provides a system for supporting an architectural element on a structure whose elements are in or tending toward a relatively stable state of equilibrium. "Homeostasis" is defined as "a relatively stable state of equilibrium or a tendency toward such a state between the different but interdependent elements or groups of elements of an organism or group." (Webster's New Collegiate Dictionary, G. & C. Merriam Co., 1976.) Hence the system of the present invention may be referred to as a homeostatic system.

The present invention provides an apparatus for supporting an architectural element upon a structure. The supporting structure includes a pair of laterally spaced apart fixed bearing members arranged on a surface beneath or adjacent to a site for an architectural element. Each bearing member may be associated with a bearing surface for engaging an elongated member. An elongated member may be arranged with a midportion extending between a pair of bearing members and end portions extending longitudinally beyond the pair of bearing members. A bearing surface may engage an elongated member at a distance spaced inwardly from one of the ends of the elongated member. An architectural element, which may comprise a base upon which one or more buildings or other architectural structures may be disposed, a building or other architectural structure, or a portion of a building or other architectural structure, may be placed in association with the elongated member.

The corresponding method includes arranging a pair of laterally spaced apart fixed bearing members on a surface beneath or adjacent to a site for an architectural element and supporting an elongated member on a bearing surface of each of the bearing members in the manner described above. An architectural element may be placed in association with the elongated member.

The elongated member of the system is capable of both supporting at least a portion of an architectural element and bending in proportion to the magnitude of a load applied to its midportion intermediate the end portions. The system of the present invention establishes an equilibrium state between the bending elongated member and the weight of the architectural element.

Beginning from a state in which an elongated member is in equilibrium with an associated architectural element, an additional load applied intermediate the ends of the elongated member causes the midportion of the elongated member to bend from a first equilibrium position an amount proportional to the magnitude of the additional load and assume a second, more downwardly bowed position. The ends of the elongated members slide against the bearing surfaces a distance also proportional to the magnitude of the additional load as the midportion bows downwardly. The movement of the elongated member establishes a new equilibrium state between the bending elongated member and the total applied load, which consists of the weight of the architectural element and the additional load. When the additional load is removed, the midportion tends to unbow, returning to substantially the same position as its original equilibrium position. The ends of the elongated member slide a corresponding distance in the opposite direction, also returning to substantially the same positions as their original equilibrium positions. The midportion of the elongated member bends and the ends of the elongated members slide in a similar manner in response to a force applied upwardly against the bottom of a bowed elongated member or in response to a force applied against any of the bearing members.

The bending and sliding of the elongated member in response to changes in the load supported by the structure may perform shock and energy absorbing functions as the elongated member engages the bearing surfaces. The absorbed energy is dissipated primarily in the form of heat generated by the frictional contact between the elongated member and the bearing surfaces. Preferably, the elongated member engages the bearing surfaces during bending under load at a preferred angle, i.e., an angle within the range of about 25 to about 50 degrees from a vertical axis of support for the structure, recognizing that angles outside this range also will achieve the desired result and are included in the present invention.

BRIEF DESCRIPTION OF THE DRAWINGS

FIG. 16 is a side elevational view of an architectural element supported by a structure in accordance with an embodiment of the present invention, showing a composite elongated member;

FIG. 17 is a side elevational view of an unloaded composite elongated member in accordance with the invention of FIG. 16;

FIG. 18 is a detail view of a single element of the composite elongated member of FIG. 17;

FIG. 19 is a sectional view of a plurality of the single elements of FIG. 17 bound as one larger composite elongated member; and FIGS. 20*a*–20*d* are sectional views of different embodiments of individual elongated members and composite shapes for a collection of elongated members.

DESCRIPTION OF PREFERRED EMBODIMENT(S)

Figure 1:
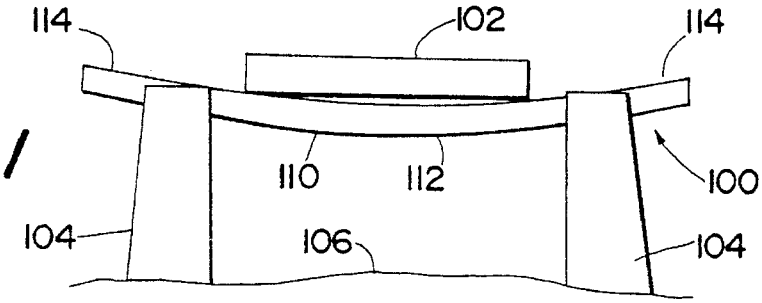
FIG. 1 is a diagrammatical side elevational view of an architectural element supported by a structure in accordance with an embodiment of the present invention.
Figure 2:
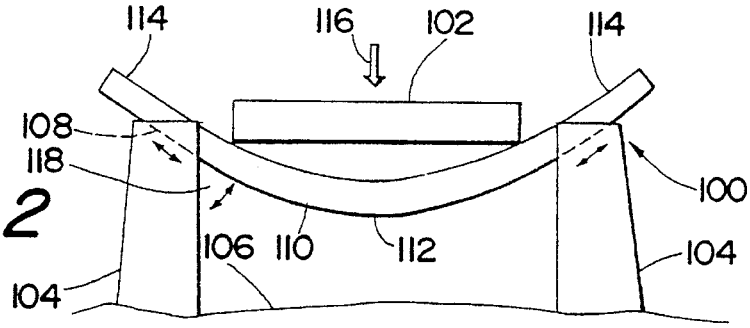
FIG. 2 is a diagrammatical side elevational view of an architectural element supported by a structure in accordance with an embodiment of the present invention, showing the structure upon application of an additional load.
Figure 8:
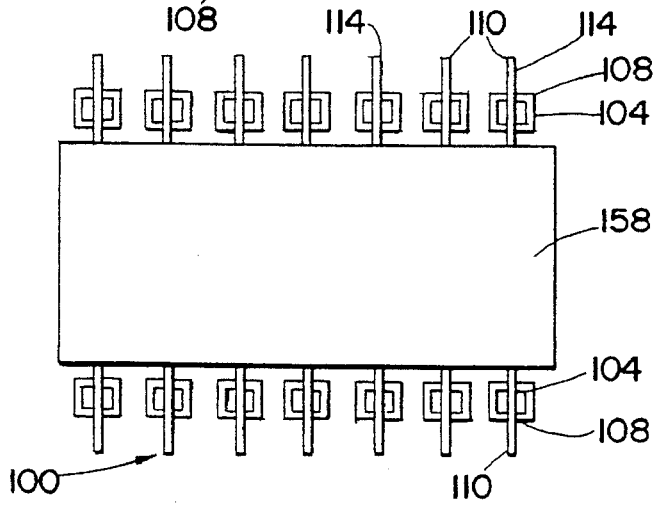
FIG. 8 is a top plan view of an architectural element supported by a structure in accordance with the invention of FIG. 7.
Figure 10:
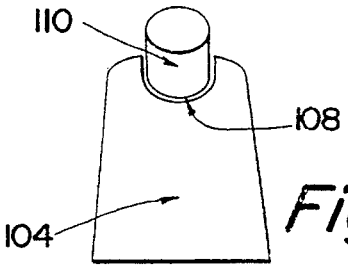
FIG. 10 is a side elevational view of a support in accordance with the invention of FIG. 7.
Figure 13:
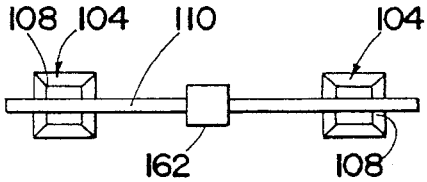
FIG. 13 is a top plan view of the support structure of FIG. 11.

Referring now to the drawings, FIGS. 1 and 2 show a structure 100 for supporting an architectural element 102 in accordance with an embodiment of the present invention. A pair of laterally spaced apart fixed bearing members 104 may be supported on a surface 106. Each bearing member 104 may define a bearing surface 108 for engaging an elongated member 110. The bearing surface 108 may be angled downwardly toward the center of the structure. The bearing surface may comprise a channel as shown in FIGS. 8 and 10.

An elongated member 110 may be arranged with a midportion 112 extending between a pair of bearing members 104 and end portions 114 extending longitudinally beyond the pair of bearing members 104. The elongated member 110 is capable of supporting at least a portion of an architectural element. The elongated member 110 also is capable of bending in proportion to the magnitude of a load 116 applied to its midportion 112 intermediate the end portions 114. A bearing surface 108 may engage the elongated member 110 at a distance spaced inwardly from one of the ends 114 of the elongated member 110.

The elongated member 110 preferably engages a bearing surface 108 at an optimal angle 118 when under load, i.e., an angle within the range of about 25 to about 50 degrees from a vertical axis of support for the structure. The angle 118 permits the supporting structure 100 optimally to absorb shock and energy, as described below. Angles outside of this preferred range also will work and are included within the scope of this invention.

An architectural element 102 may be placed in association with the elongated member 110. The architectural element 102 may have a horizontal, vertical, or other orientation relative to the elongated member 110. The system establishes an equilibrium state between a bending elongated member 110 and the weight of the architectural element 102.

Figure 3:
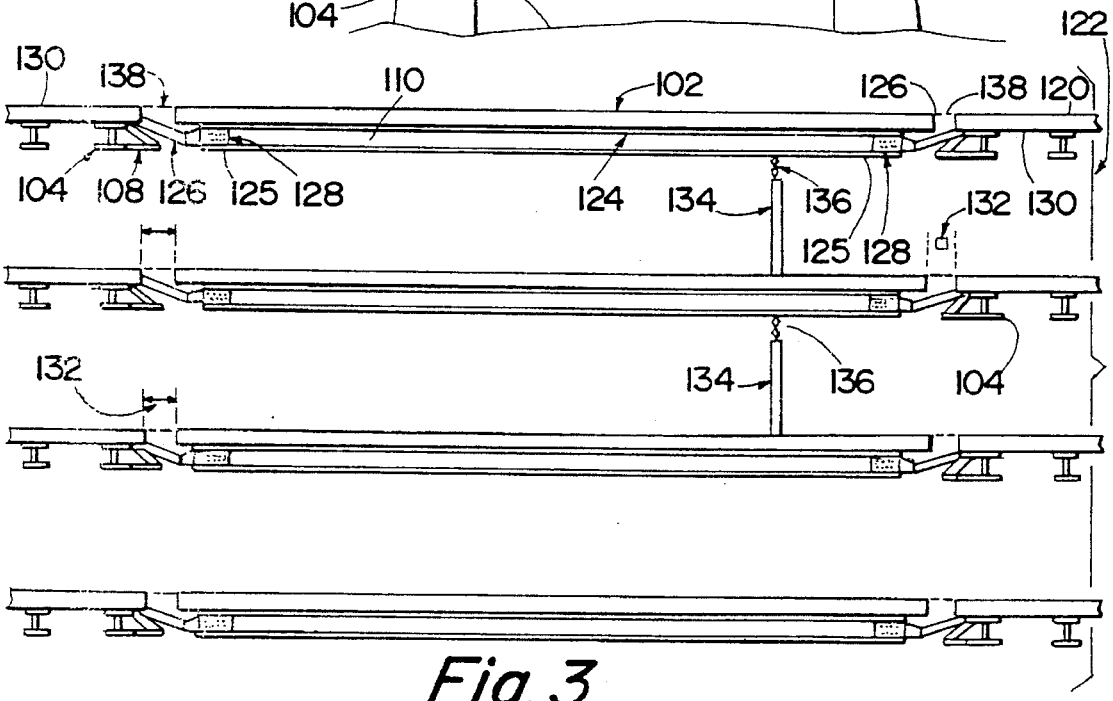
FIG. 3 is a fragmentary cross-sectional view of an architectural element supported by a structure in accordance with an embodiment of the present invention.
Figure 4:
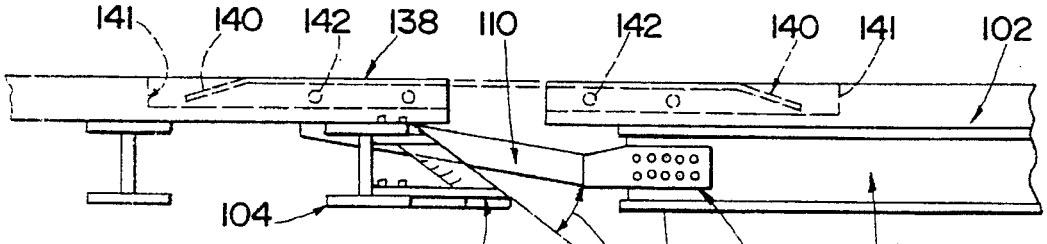
FIG. 4 is a detail view of a portion of a support for an architectural element in accordance with the invention of FIG. 3.

FIGS. 3 and 4 show an embodiment of the invention in which a plurality of horizontal architectural elements 102 are supported independently from horizontal members 120 of the frame of a building 122. The laterally spaced apart fixed bearing members 104 are suspended from opposing horizontal frame members 120. Each of the bearing surfaces or mechanisms 108 of a pair of bearing members 104 may be arranged at substantially the same elevation relative to the frame 120. The elongated member 110 may engage the bearing mechanisms 108 of the bearing members 104 arranged at a particular elevation within the building 122. As shown in FIGS. 3 and 4, elongated members 110 that engage bearing mechanisms 108 at the same elevation may cooperate in supporting an architectural element 102 disposed thereupon. Additional elongated members 110 may engage the bearing mechanisms 108 of bearing members 104 arranged at other elevations to support a plurality of architectural elements 102, such as floors, located at different elevations or levels within the building 122. Elongated members 110 that engage bearing mechanisms 108 at one level act independently of elongated members 110 that engage bearing mechanisms 108 at a different level, allowing earthquake-resistance to be provided to each such element or floor independently of other elements or floors within the building 122, as shown in FIG. 3.

The elongated member 110 may be a combination member including a rigid midportion 124, such as the floor-supporting beam shown in FIG. 3, having opposite sides 125 and a flexible end portions 126 attached to each of the sides 125. The flexible end portions 126 may be attached to the sides 125 of the rigid midportion 124 by fastening means 128 such as bolts.

An architectural member 102 may be supported upon the elongated member 110. Preferably, the architectural member 102 is arranged horizontally between the laterally spaced apart fixed bearing members 104 to form a central portion of the floor of the building 122. The central portion 102 of the floor may be moveable relative to edge portions 130 of the floor associated with the building frame 120. Sufficient horizontal clearance 132 between the edge portions 130 and the central portion 102 is provided to accommodate movement of the central portion 102 on its bearing members 104. Interior walls or partitions 134 placed upon the central portion 102 of the floor may be sized to provide sufficient vertical clearance 136 between the walls 134 and any overlying elongated member 110 within the building 122. The vertical clearance 136 will accommodate movement of the central portion 102 on which the walls 134 are placed relative to its bearing members 104.

An apron 138 may overlay any horizontal or vertical gap 132 between the central portion 102 and the edge portions 130 of the floor to facilitate access from the edge portions 130 to the central portion 102 and vice versa as shown in FIG. 3. The apron 138 may be attached to the central portion 102 and the edge portions 130 of the floor by attachment means 140 such as hinges located in a recess 141 of the floor surface, as shown by the dotted lines in FIGS. 3 and 4. The apron 138 may be moveable relative to the central portion 102 and the edge portions 130 of the floor, for example, by rollers 142 or other slidable means.

Figure 5:
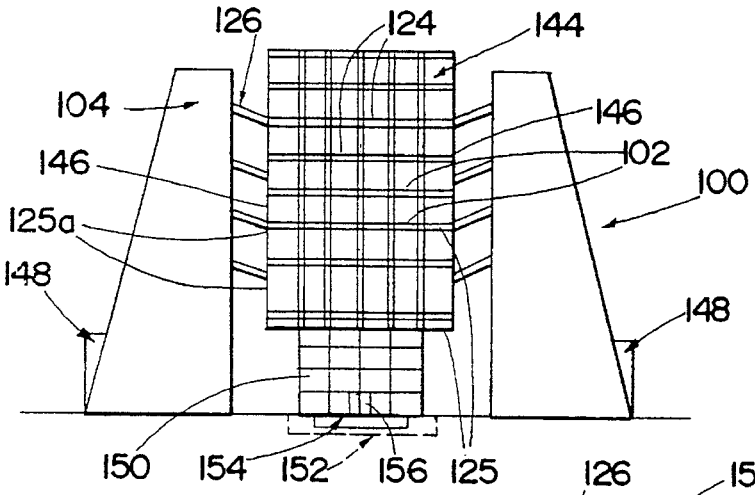
FIG. 5 is a side elevational view of an architectural element supported by a structure in accordance with an embodiment of the present invention.
Figure 6:
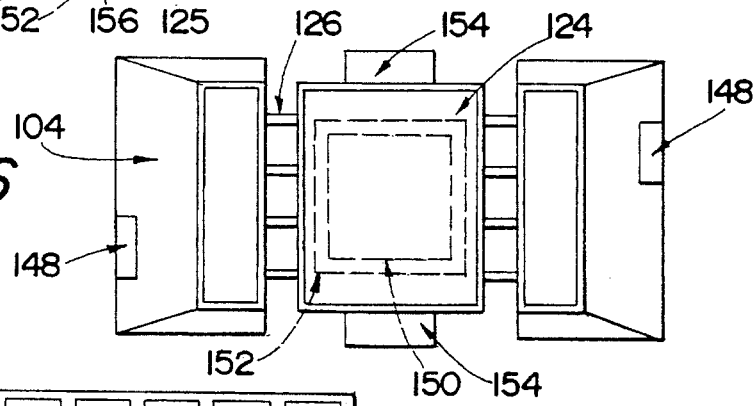
FIG. 6 is a top plan view of an architectural element supported by a structure in accordance with the invention of FIG. 5.

FIGS. 5 and 6 show an embodiment of the present invention in which a building 144 is supported by a structure. The elongated member 110 may comprise a combination member having a rigid midportion 124. A pair of vertical architectural elements 125a may extend from opposite sides 125 of the rigid midportion 124. The floor or floors 103 of the building 144 may be supported from the vertical elements 125*a*. A flexible end portion 126 may be secured to the outer surface of each of the vertical architectural elements 125*a*. The flexible end portions may be secured to the elements 102 or 125*a* by welding, bolts, or other suitable means. Alternatively, the rigid midportion 124 of the elongated member 110 may comprise a horizontal architectural element on which a floor 103 may be supported. The flexible end portions 126 may be secured to opposite sides 125 of the rigid midportion 124 in the manner described above.

Laterally spaced apart fixed bearing members 104 arranged on opposing sides 146 of the building 144 engage the flexible end portions 126 of the elongated member 110 at a distance spaced inwardly from the ends 114. The elongated member 110 may engage bearing surfaces 108 associated with the fixed bearing members 104, as shown in FIG. 10. The bearing surfaces 108 may be disposed within the fixed bearing members 104, with the ends of the elongated member 110 moveable relative to the bearing surfaces 108 within the fixed bearing members 104.

The entire building 144 may be moveable relative to the fixed bearing members 104. The building 144 may be used for purposes which require isolation from seismic shock or surface conditions. The bearing members 104 may be provided with access means 148 such that the interior of the bearing members 104 may be used for purposes such as parking, utilities, and storage which do not require isolation.

The lower floor or floors 150 in an isolated building 144 may be suspended from a combination elongated member 110. Sufficient vertical clearance 152 may be provided between the lowermost portion 150 of the building 144 and the ground surface 106 to accommodate movement of the building 144 relative to its bearing members 104. A sliding apron 154 may be provided to overlay any gap 152 between a door 156 or other access means in the lowermost portion 150 of the building 144 and the ground 106 to facilitate access to the building 144.

Figure 7:
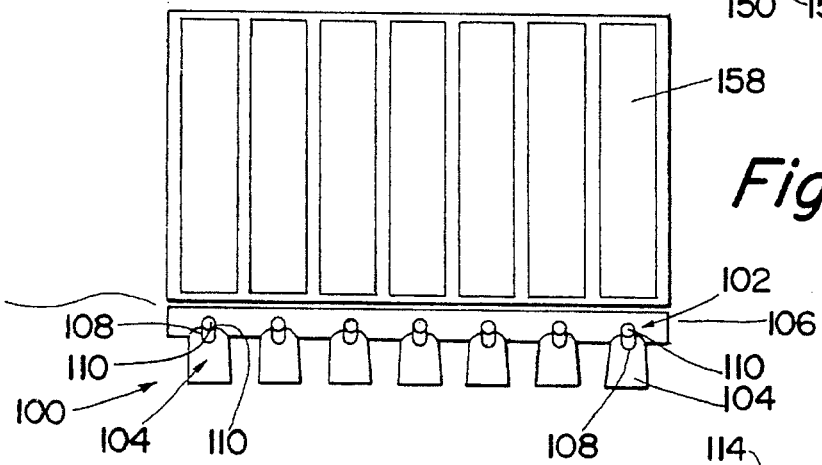
FIG. 7 is a side elevational view of an architectural element supported by a structure in accordance with an embodiment of the present invention.
Figure 15:
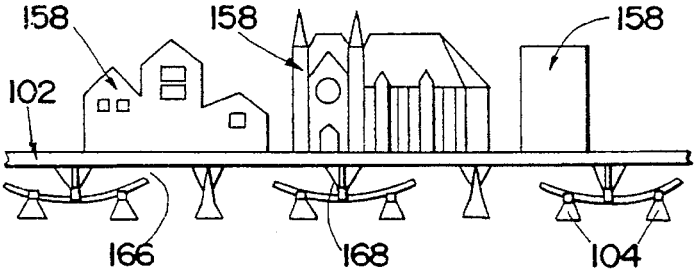
FIG. 15 is a side elevational view of an architectural element supported by a structure in accordance with an embodiment of the present invention.

FIGS. 7 and 8 show an embodiment of the present invention in which a building 158 is supported upon an architectural element or platform 102 which in turn is supported upon a supporting structure 100. The supporting structure 100 may comprise a plurality of elongated members 110 supported upon a corresponding number of pairs of bearing members 104. FIG. 15 shows a similar embodiment in which a number of buildings 158 or other structures are placed upon such a supported platform 102. The platform 102 in either of these embodiments may be positioned above or below the ground surface 106.

Figure 9:
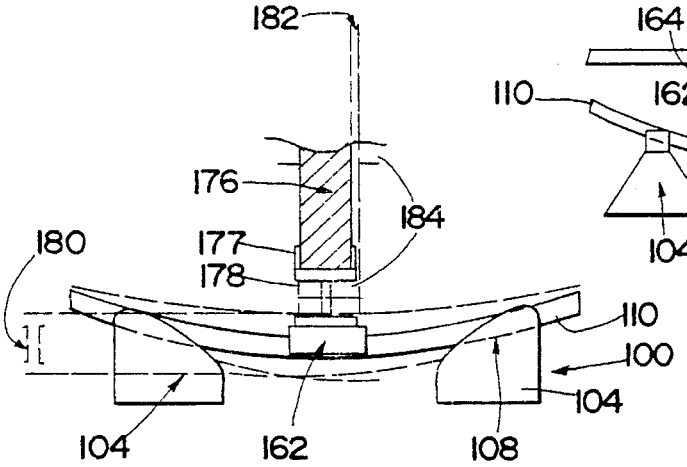
FIG. 9 is a cross-sectional view of an architectural element supported by a structure in accordance with an embodiment of the present invention, showing a side elevational view of the supporting structure.
Figure 11:
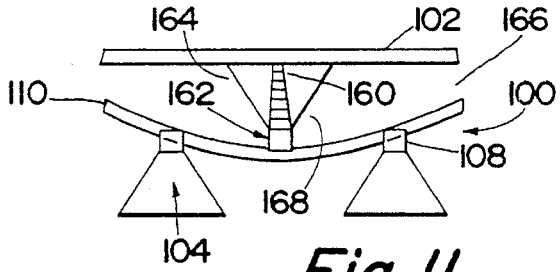
FIG. 11 is a side elevational view of an architectural element supported by a structure in accordance with an embodiment of the present invention.
Figure 12:
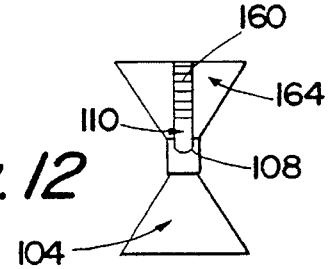
FIG. 12 is an end view of the support structure of FIG. 11.

FIG. 9 shows an embodiment of the present invention in which an architectural element or platform 102 is supported upon a supporting structure 100. The platform 102 may engage a vertical bearing structure 160 provided within a bearing mount 162, such as the bearing mount shown in FIG. 10, which in turn may engage an elongated member 110 as shown in FIGS. 9–12. The vertical bearing structure 160 may be provided with vertical bearing supports 164 as shown in FIGS. 11 and 12.

The platform 102 may overhang the supporting structure 100 as shown in FIGS. 11 and 15. In such an embodiment, the platform 102 must be elevated above the ends 114 of the elongated members 110 to provide adequate clearance 166 for the bending of the elongated members 110. This may be accomplished by interposing spacer means 168 between an elongated member 110 and the platform 102. The spacer means 168 may comprise the vertical bearing structure 160.

FIG. 9 shows an embodiment of the present invention in which a building 175 is supported upon an architectural element 178. The architectural element 178 may comprise a rigid frame rather than the continuous platform of FIGS. 7 and 8. Each building support member 176 of the building 175, such as a foundation wall, may be supported upon a portion of the frame 178. Reinforcing means 177 may be provided in conjunction with the building support members 176 in the vicinity of the frame 178. Each portion of the frame 178 may be supported on one or more supporting structures 100. This embodiment of the invention may have particular application in retrofitting an existing structure 175 to isolate the structure from seismic shocks or surface conditions, because the frame 178 and its associated supporting structures 100 may be installed beneath the building support members 176 of an existing structure 175.

Figure 14:
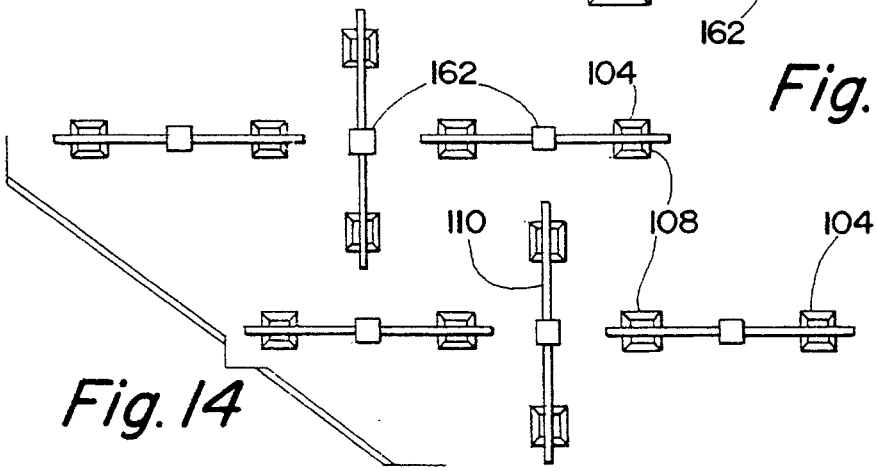
FIG. 14 is a top plan view of a plurality of support structures in accordance with the invention of FIG. 11.

As may be seen from FIGS. 7–8 and 14, the pairs of bearing members 104 may be arranged in a predetermined pattern relative to other of the pairs 104. FIGS. 7 and 8 show a parallel arrangement of the pairs of bearing members 104 whereas FIG. 14 shows a staggered perpendicular pattern. The pairs of bearing members also may be arranged in a predetermined pattern relative to an architectural element 102, 178. For example, one of each pair of bearing members may be arranged in an area underlying a building 178 and the other of each pair may be arranged outside an outer wall of the building 178, such that the lowermost portion of the outer wall of the building engages the midportion 112 of the elongated member supported on each pair of bearing members, as shown in FIG. 9.

The elongated member 110 may be a unitary member as shown in FIGS. 1–2, or a composite flexible member 170 as shown in FIG. 16. The composite member 170, as shown in FIG. 17, may be a bundle of elongated member subunits 172, shown in FIG. 18, held together by a restraining band 174, or a plurality of restraining bands 174 disposed at predetermined distances along the bundle 170. In FIG. 19, the composite member 170 is shown in cross-section, revealing the subunits 172 and the band 174. An elongated subunit 172 may be of hollow or solid cross-section of any appropriate shape as shown in FIGS. 20*a–d*. The cross-section of a composite member 170 also may be of any appropriate shape as shown in FIGS. 19 and 20*a–b*.

The system of the present invention performs as described below. Beginning from an initial equilibrium state in which an architectural element 102, 178 is associated with the midportion 112 of an elongated member 110, as shown in FIGS. 1 and 9, an additional load 116 applied intermediate the ends 114 of the elongated member 110 causes the midportion 112 of the elongated member 110 to bend from a first equilibrium position an amount proportional to the magnitude of the additional load 116 and assume a second, more downwardly bowed position as shown by the dotted lines in FIG. 2 and 9. The ends 114 of the elongated member 110 slide against their respective bearing surfaces 108 a distance also proportional to the magnitude of the additional load 116 as the midportion 112 bows downwardly. The movement of the elongated member 110 establishes a new equilibrium state between the bending elongated member 110 and the total applied load, which consists of the weight of the architectural element 102, 178 and the additional load 116. When the additional load 116 is removed, the midportion 112 unbows, returning to substantially the same position as its original and slightly bowed equilibrium position. The ends 114 of the elongated member 110 slide a corresponding distance in the opposite direction, also returning to substantially the same positions as their original equilibrium positions. In a similar manner, the midportion 112 of the elongated member 110 bows upwardly and the ends 114 slide relative to their respective bearing surfaces 108 in response to a force applied upwardly against the bottom of the elongated member 110.

When an architectural element is associated with at least two elongated members 110, each of the elongated members 110 supports only the share of the architectural element 102 that is acting directly above it. In addition, each of the ends 114 is capable of unique and distinct movement on its respective bearing surface 108 with respect to any of the other ends 114 i.e., the ends of each elongated member move as the member seeks an equilibrium position, in response to bending of the midportions 112 or external forces applied to any of the bearing members 104. If an applied force does not remove any of the bearing members 104 from engagement with its respective elongated member 110, the architectural element 102, 178 and its supporting structure 100 will return substantially to their original equilibrium positions with a minimum of oscillation. If any of the bearing members 104 is deformed or otherwise removed from engagement with its respective elongated member 110, the architectural element 102, 178 and its supporting structure 100 will reach a new equilibrium state, in which the displacement of the architectural element 102, 178 from its original position may be proportional to the product of the number of elongated member ends 114 displaced and the total displacement of those ends 114, and inversely proportional to the number of elongated member ends 114 that remain supported by bearing members 104. Stated another way, the total displacement of the architectural element 102, 178 from its original position generally will be some fraction of the total displacement of the ends 114, with the fractional numerator representing the number of ends 114 displaced and the fractional denominator representing the total number of support ends 114 in the structure 100. For example, as shown by the dotted lines in FIG. 9, the range of horizontal movement 182 and vertical movement 184 for the frame 178 and the wall 176 supported thereon are small relative to the range of vertical movement 180 of the elongated member 110 of the supporting structure 100.

The above-described preferred embodiments should not be construed as limiting and are susceptible to modification by one skilled in the art. Such modification is considered to be within the spirit of the present invention and under the protection of the following claims. This invention is a pioneer invention deserving of a broad scope of coverage.

What is claimed is:

1. A method for isolating an architectural element within an architectural structure, said method comprising the steps of:

providing the architectural structure with a frame having a pair of laterally spaced apart opposing members;

suspending a fixed bearing support from a lower surface of each of the frame members in opposing relationship;

forming each of said bearing supports with a bearing surface for engaging an elongated elastic member;

selecting a pair of elongated elastic members each capable of bending from an equilibrium position to assume a more downwardly inclined position when the elastic member is supported at a distance spaced inwardly from its outer end and a load is applied to its inner end;

connecting an inner end of each of said elastic members to opposing sides of an architectural element;

arranging said architectural element between said pair of bearing supports with the outer ends of said elastic members extending longitudinally beyond said pair of bearing supports; and placing said elastic members in engagement with bearing surfaces on their respective bearing supports to enable said outer ends of said elastic members to slidably move relative to their respective bearing supports in response to a bending of an inner end of one of said elastic support members or in response to external forces applied to one of the bearing supports.

2. The method of claim 1, further comprising the step of:

supporting a floor on said architectural element.

3. The method of claim 1, further comprising the step of:

arranging said bearing surfaces to engage said elastic members at an angle within the range of about 25 to about 50 degrees from a vertical axis of each of said bearing members.

4. The method of claim 2, further comprising the step of:

providing clearance between said ends of said elastic members and a floor overhanging said ends.

* * * * *